US005269239A

United States Patent [19]

Adamski, Jr. et al.

[11] Patent Number: 5,269,239

[45] Date of Patent: Dec. 14, 1993

[54] AUTOMATIC ATTACHMENT OF PRE-CLOSED ELASTIC WAISTBANDS

[75] Inventors: Maximilian Adamski, Jr., Palatine; Don M. Ford, Eligin, both of Ill.

[73] Assignee: Union Special Corporation, Chicago, Ill.

[21] Appl. No.: 978,145

[22] Filed: Nov. 16, 1992

Related U.S. Application Data

[63] Continuation of Ser. No. 580,128, Sep. 10, 1990.

[51] Int. Cl.[5] ..... D05B 27/12

[52] U.S. Cl. ..... 112/121.27; 112/305; 112/306; 112/322; 112/63; 112/318

[58] Field of Search ..... 112/121.26, 121.27, 112/305, 306, 322, 147, 153, 63, 318

[56] References Cited

U.S. PATENT DOCUMENTS

| | | | |
|---|---|---|---|
| 2,630,773 | 3/1953 | Caprara et al. | 112/121.26 |
| 4,046,087 | 9/1977 | Manetti | 112/121.26 X |
| 4,185,570 | 1/1980 | Kleinschmidt et al. | 112/121.27 X |
| 4,191,117 | 3/1980 | Della Torre | 112/121.26 X |
| 4,467,734 | 8/1984 | Rohr | 112/63 |
| 4,473,017 | 9/1984 | Letard et al. | 112/141 |
| 4,479,447 | 10/1984 | Rohr | 112/141 |
| 4,512,268 | 4/1985 | Rohr | 112/63 |
| 4,602,579 | 7/1986 | Pollmeier et al. | 112/121.26 |
| 4,703,706 | 11/1987 | Plante | 112/121.26 X |
| 4,714,036 | 12/1987 | Raisin et al. | 112/121.27 X |
| 4,744,319 | 5/1988 | Rohr | 112/306 |
| 4,827,856 | 5/1989 | Rohr | 112/63 |
| 4,827,857 | 5/1989 | Fieschi | 112/121.26 |
| 4,860,676 | 8/1989 | Kawai et al. | 112/121.26 X |
| 4,883,005 | 11/1989 | Wehmeyer | 112/121.26 X |
| 4,967,674 | 11/1990 | Rohr et al. | 112/63 |
| 5,131,336 | 7/1992 | Kono et al. | 112/121.27 X |

FOREIGN PATENT DOCUMENTS

| | | | |
|---|---|---|---|
| 3704856 | 8/1988 | Fed. Rep. of Germany . | |
| 62-249686 | 10/1987 | Japan | 112/63 |
| 301251 | 11/1928 | United Kingdom . | |
| 343318 | 2/1931 | United Kingdom . | |
| 2064601 | 6/1981 | United Kingdom . | |
| 2230907 | 12/1988 | United Kingdom . | |
| 2219319 | 5/1989 | United Kingdom . | |
| 2247695 | 11/1992 | United Kingdom | 112/121.27 |

*Primary Examiner*—Clifford D. Crowder
*Assistant Examiner*—Paul C. Lewis
*Attorney, Agent, or Firm*—Morgan & Finnegan

[57] ABSTRACT

An apparatus for and method of attaching an elastic band to the body of a garment is provided. The workpieces are monitored and aligned during the attachment process by sensors and guide mechanisms, electrically coupled to a controller that facilitates the activities, while a tensioning mechanism maintains the workpieces in a desired configuration. The use of the apparatus and method results in an efficient and automatic process of attachment that eliminates the need for an operator to manually align and guide the workpieces through the sewing instrumentality.

9 Claims, 8 Drawing Sheets

AUTOMATIC ATTACHMENT OF PRE-CLOSED ELASTIC WAISTBANDS

This is a continuation of co-pending application Ser. No. 07/580,128, filed on Sep. 10, 1990.

FIELD OF THE INVENTION

The present invention relates to an apparatus for and method of sewing, and more particularly, to an apparatus and method for the automatic attachment of pre-closed circular elastic waist bands to the body portion of a circular garment.

DESCRIPTION OF THE PRIOR ART

Automation of sewing operations has existed for many years. Over time, machines and methods have been developed that allow operators to position pieces of material in a specified location where, thereafter, the sewing machines would complete the aligning and sewing operation. An operation is simplest when there is one workpiece and the geometry of the material sewn is basic (e.g. straight edges), the configuration of the sewn material is easy to maintain during the sewing operation (e.g. an even alignment), and the path of the stitching is not complicated (e.g. straight and flat).

Automatic aligning and sewing is complicated when the characteristics of the material to be sewn venture from the basic, e.g. the sewing of an elastic closed-loop workpiece material to a tubular edges of another non-elastic workpiece. The operator, or the machine, must strive to align the materials such that, when sewn together, the non-elastic and elastic workpieces are configured with the desired amount of tension in the different materials. If either material is not tensioned properly, the resulting combination will have problem areas where the look, feel and final size of the completed garment could be unacceptable.

The configuration of the elastic and non-elastic materials is critical when the elastic material is being used as a waistband. The elastic material is susceptible to more noticeable flaw in its configuration with the non-elastic materials because the ends of the elastic material must be joined to form a loop. If the alignment of the two materials is not accurate, the elastic loop may not close properly decreasing the quality of the completed garment.

The garments' waist band can be sewn closed with more accuracy if the loop is closed before the band is sewn to the body of the garment. However, it is burdensome thereafter to attach the pre-closed band to the body of a garment because the time and skill necessary to maneuver the materials during the sewing operation decreases the efficiency and speed of the entire process. It is time consuming for an operator to manually align the materials, begin to sew, and then have to realign the materials periodically throughout the sewing operation until the stitching is complete. This tediousness results from the difficulty in positioning any loop material, elastic or otherwise, in proper alignment with the body of a garment and thereafter sewing the materials together in a continuous operation, maintaining the alignment such that the entire loop is sewn to the rest of the garment in the desired configuration.

What is needed is a device or method that is efficient, accurate, speedy and automatic. Such a device or method would most desirably eliminate the need for manual positioning of the materials in relation to each other during the sewing operation, and keep both materials at in proper tension, while also eliminating the need for manual maneuvering of the aligned workpieces through the sewing machine. The presently known devices and methods have been less than adequate for sewing preclosed elastic bands onto other materials.

For example, U.S. Pat. No. 4,479,447 and U.S. Pat. No. 4,827,856, both issued to Rohr, discloses an embodiment that sews the edge of a tubular workpiece. Two other patents issued to Rohr, U.S. Pat. No. 4,512,268 and U.S. Pat. No. 4,467,734, and U.S. Pat. No. 4,473,017, issued to Letard et. al., relate to sewing apparatus that support and tension a tubular workpiece while the workpiece passes through a sewing machine. The typical workpiece here is a garment with a hem or other edge that must be sewn in place. U.S. Pat. No. 4,744,319, also issued to Rohr, discloses a device that controls a workpiece during a sewing operation. The device is applicable for sewing flat (open) materials—it feeds material in a substantially straight line.

It is, therefore, an object of the present invention to provide a new and improved apparatus for and method of automatically attaching elastic band materials onto garment bodies to allow the operator to load a second machine while the first machine is joining the elastic band to the body of the garment, thereby increasing productivity.

It is a further object of the invention to provide a new and improved apparatus for and method of attaching pre-closed circular elastic waistbands to circular underwear, swimwear, etc.

Still another object of the present invention is to provide a new and improved apparatus for and method of joining a pre-closed band to another portion of a garment while expanding and tensioning the materials as necessary for a proper configuration of the completed garment.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

The above-mentioned and other objective of the invention are met by a new and improved apparatus and a method according to the present invention. The preferred method of attaching the elastic bands to the body of the garments includes sensing when the materials are in position, tensioning the materials, urging the materials through the sewing machine at the same time the materials are kept in tension and in their desired alignment, monitoring the alignment and position of the materials such that corrections in their alignment and position may be made as deemed necessary, and automatically terminating the sewing process when the stitching is completed.

In a preferred embodiment, the attachment apparatus includes a frame, sensors that can determine when the elastic band and the body of the garment are present, a guiding mechanism that maneuvers the edge of the garment and maintains the desired alignment while the materials are attached to each other, a tensioning component that ensures the maintenance of the proper tension in the two materials during the sewing process, sensors that monitor the alignment and position of the workpieces such that their signal may be used to maneuver the workpieces to the desired positions, and a sewing machine that completes the attachment process.

It will be appreciated by those skilled in the art that the foregoing brief description and the following detailed description are exemplary and explanatory of the invention, but are not intended to be restrictive thereof or limiting of the advantages which can be achieved by the invention. Thus, the accompanying drawings, referred to herein and constituting a part hereof, illustrate preferred embodiments of the invention and, together with the detailed description, serve to explain the principles of the invention.

BRIEF DESCRIPTION OF THE DRAWINGS

The above and other objects, features and advantages of this invention will be apparent from the following detailed description, especially when taken in conjunction with the accompanying drawings, wherein.

DETAILED DESCRIPTION OF THE PREFERRED EMBODIMENTS

Figure 1:
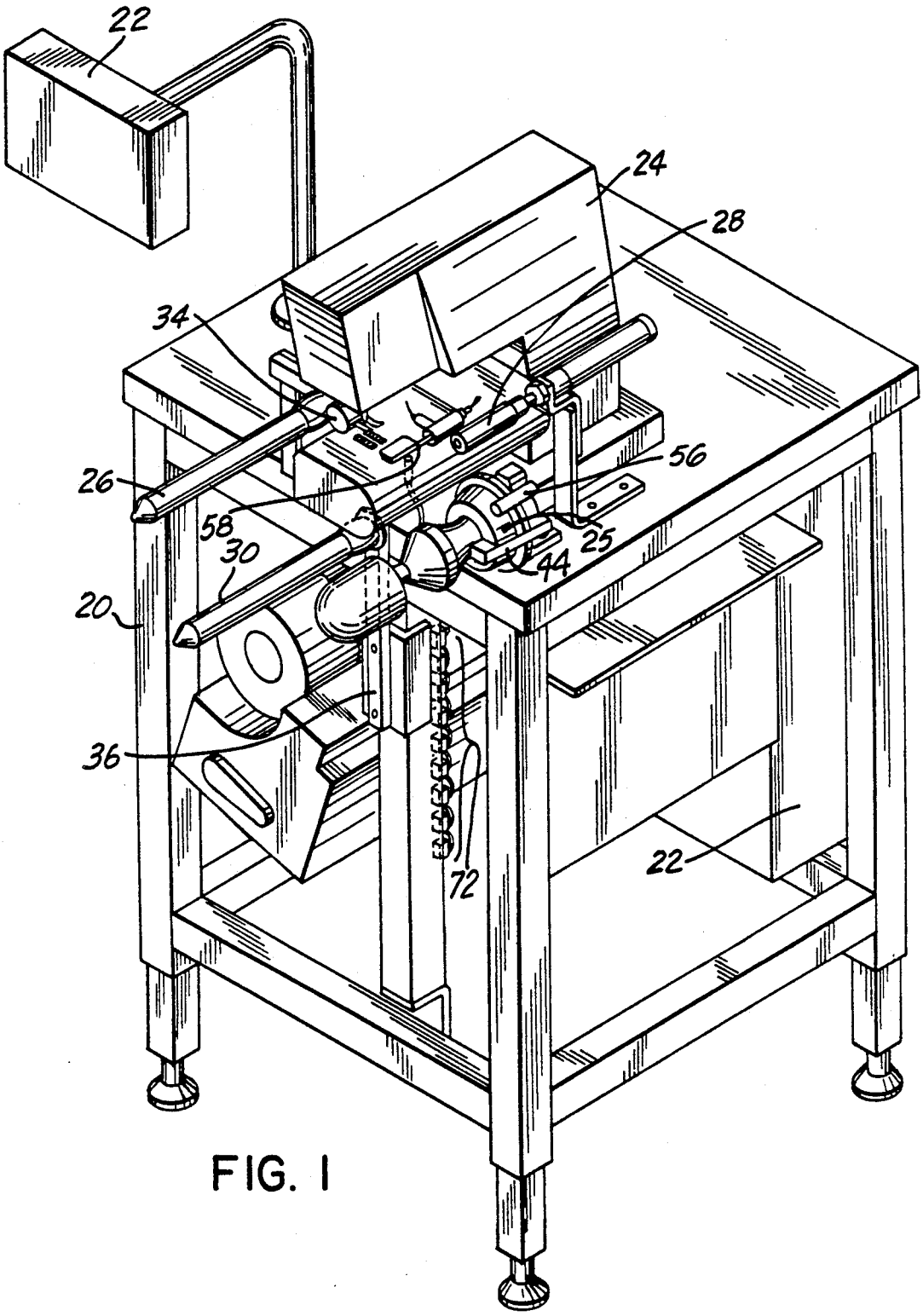
FIG. 1 is an perspective view of an attachment apparatus according to the invention and its elements.

Referring to the drawings, a preferred embodiment of the attachment apparatus, according to the present invention, is illustrated in FIG. 1. In this particular embodiment, frame 20 supports the attachment apparatus. Control system box 22 is secured to the lower, back portion of frame 20. Inside control system box 22 are the central processing unit (CPU) that activates and monitors the sewing and maneuvering operations. The motor controls for the various moving components are also located in control system box 22.

Sewing machine 24 is affixed to the top of frame 20. Sewing machine 24 is electrically connected with the appropriate controls in control box 22.

Also electrically connected to the appropriate controls in control box 22 are the motors for the manipulating cylinder for top roller 28, for rear puller roller 34, and for tension roller carriage 36.

End of sew proximity sensor 58, top roller proximity sensor 56, coarse edge guider sensor 44 and variable home and selected position magnetic proximity sensors 72 are mechanically connected to the attachment apparatus at various locations and are electrically connected with control box 22. Each sensor produces a signal that is used to control various steps in the attachment process. Roller 25, roller 26 and tension roller 30 are also shown.

Figure 2:
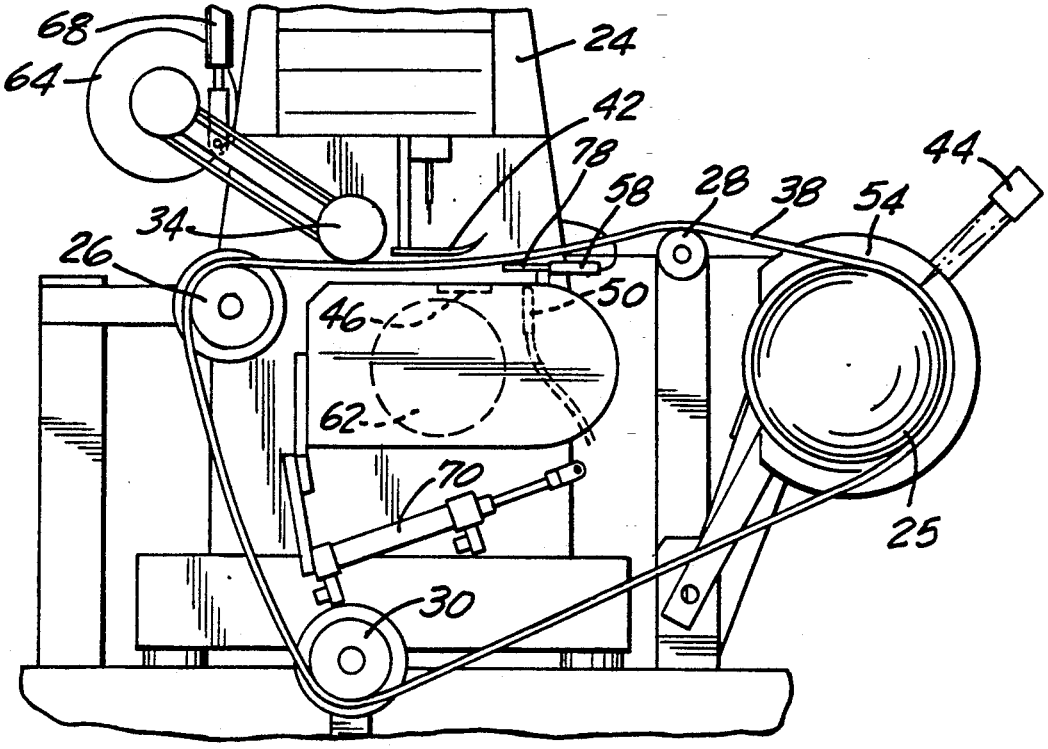
FIG. 2 is a plane view of the elements of the apparatus that initially come into contact with an elastic band workpiece.
Figure 3:
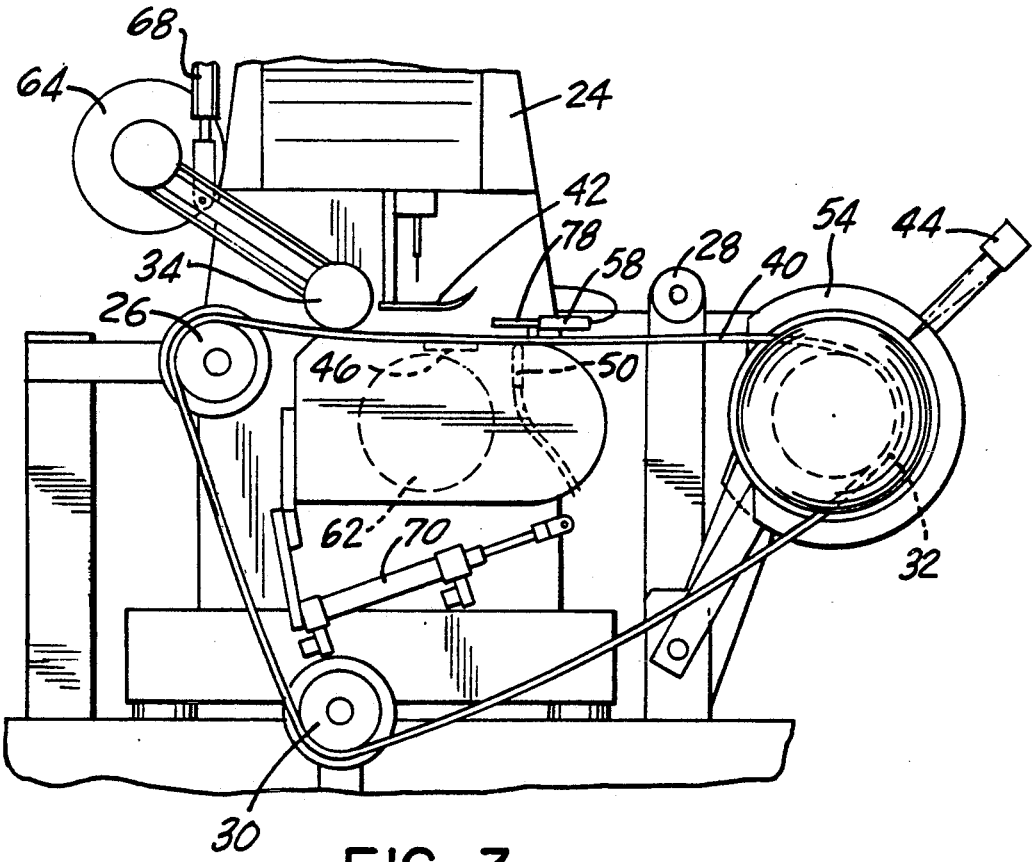
FIG. 3 is a plane view of the elements of the apparatus that initially come into contact with a garment body workpiece.

FIGS. 2 and 3 show a more detailed view of maneuvering components in reference to the position of elastic band 38 and garment body 40 after the two workpieces have been positioned in the attachment apparatus, just before the sewing operation has begun. The operator manually loads elastic band 38 first, positioning band 38 against edge stop 54. It will be apparent to one skilled in the art that the loading of either elastic band 38 or garment body 40, or both may be accomplished by a mechanical or automated means.

Elastic band 38 is typically a pre-closed circular waist band, but may be the band of another piece of a garment (e.g. a collar, a wrist band) and needed not be elastic. The invention, however, it designed to attach elastic bands to garments, a more difficult sewing operation.

Elastic band 38 is situated such that it is under presser foot 42 of sewing machine 24 and over roller 25, roller 26, top roller 28 and tension roller 30 Roller 25, roller 26, top roller 28 and tension roller 30 rotate relative to the movement of elastic band 38. Roller 25, roller 26, top roller 28 and tension roller 30 should be constructed of materials appropriate to maneuver elastic band 38 without allowing slippage and without causing undesirable wear and tear on elastic band 38 during the sewing operations. The two long rollers (tension roller 30 and roller 26) should preferably have crowned sections to keep the elastic band on track. However, roller 25 is preferably tapered with a high friction surface to prevent elastic band 38 from slipping until the tensioning is completed. The taper should force elastic band 38 on the wider portion of roller 25 toward the fixed edge stop 54, and away from the open edge of roller 25.

The portion of garment body 40 on to which elastic band 38 will be attached is manually situated (in this particular embodiment) over the coarse guider roller 32. Like the other rollers, coarse guider roller 32 should be of a material and size appropriate for maneuvering garment body 40 during the sewing operation in the desired fashion. Moreover, the roller is preferable smooth with low friction so that garment body 40 can move when responding to the edge aligning forces.

Garment body 40 is then routed under presser foot 42, located to cover coarse edge guider sensor 44 and fine edge guider sensors 50 and then positioned over tension roller 30 and roller 26. Coarse edge guider sensor 44 may be of such a type as that disclosed in U.S. Pat. No. 4,467,734, issued to Rohr on Aug. 28, 1984, which is incorporated by reference. It monitors the alignment and produces a signal that may be used to make rough alignment adjustments. On the other hand, fine edge guider sensor 50 may be of such a type as disclosed in U.S. Pat. No. 4,744,319, issued to Rohr on May 17, 1988, which is incorporated by reference. It provides the signal that controls, for instance, a fine alignment mechanism incorporated in the sewing head that maintains the edge of garment body 40 in a very precise location during sewing. Fine edge guider sensor 50 may be, for example, a photo optic sensor that reflects off an object above it.

Although the sequence of positioning the two workpieces over the rollers and under presser foot 42 may differ, the initial configuration, in this embodiment, is critical. That is, in the loaded, pre-sewn configuration, elastic band 38 should be under presser foot 42 and over roller 25, roller 26, tension roller 30 and top roller 28 while garment body 40 should be positioned under presser foot 42 and over coarse guider roller 32, roller 26, tension roller 30, fine edge guider sensor 50 and coarse edge guider sensor 44. The remainder of garment body 40, that which is not being attached to elastic band 38, should be allowed to fall between the attachment apparatus and the operator.

End of sew proximity sensor 58 sits in between elastic band 38 and garment body 40 when the workpieces are loaded. End of sew proximity sensor 58 has a flag 78 which is positioned above fine edge guider sensor 50 until flag 78 is moved by the stitch joining the workpieces (see discussion of FIGS. 5*b* and 5*c*). Under garment body 40, stepper motor 62 is positioned to move the aligning feed dog in response to the signal generated by fine edge guider sensor 50. Stepper motor 62 may be of the type, for example, disclosed in U.S. Pat. No. 4,467,734. Feed dog 46 which helps urge the workpieces from one side of presser foot 42 to the other may be of the kind, for example, disclosed in U.S. Pat. No. 4,744,319. Rear puller motor 64 is in position to rotate rear puller roller 34 when rear puller roller 34 is lowered onto elastic band 38 and garment body 40 by rear puller lift cylinder 68. Knife throw out cylinder 70 is poised to place the cutting knife in its normal operative position after elastic band 38 and garment body 40 are in place.

Figure 4:
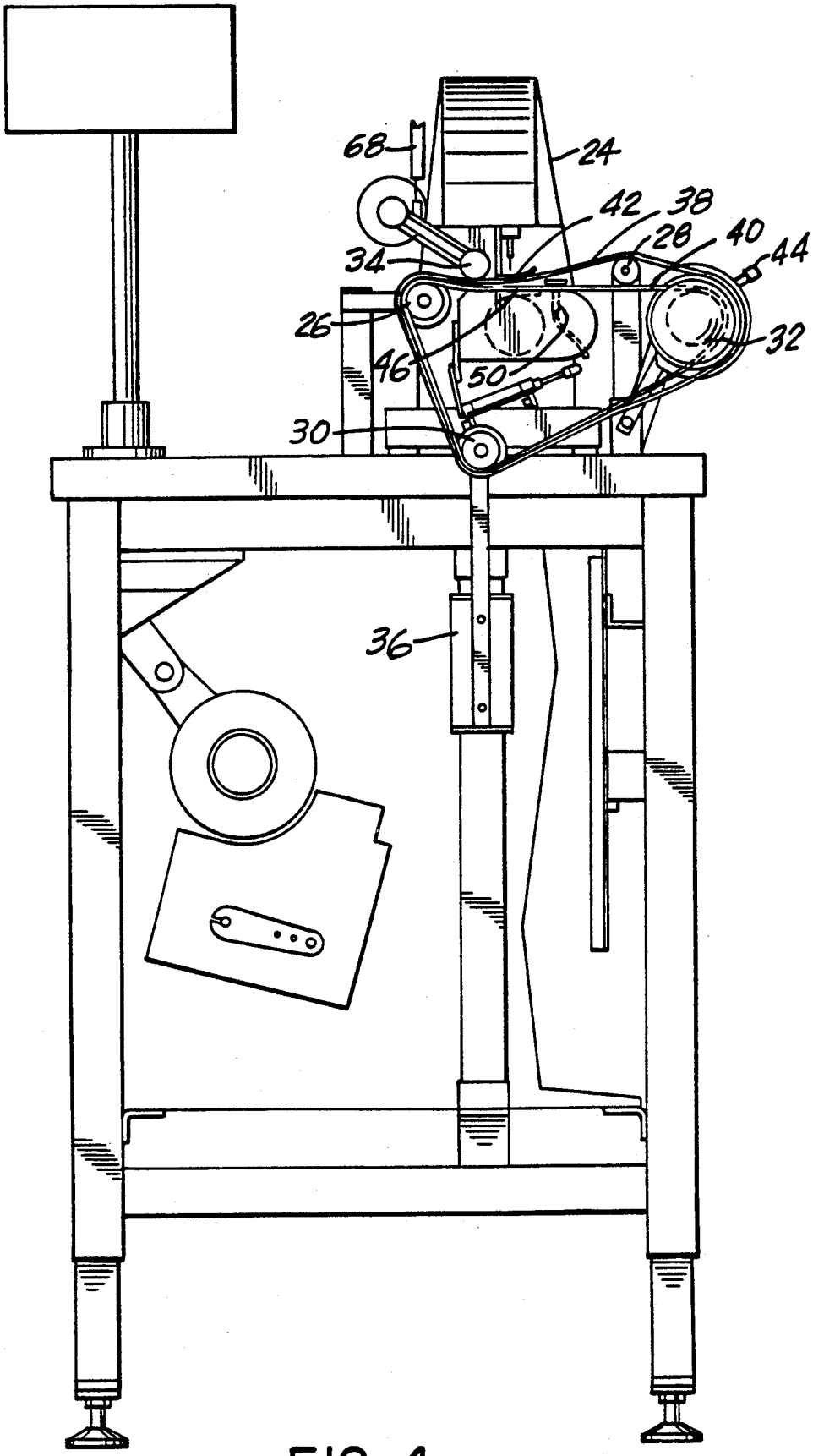
FIG. 4 is a plan view of an attachment apparatus according to the invention with elastic band and garment body workpieces.
Figure 5:
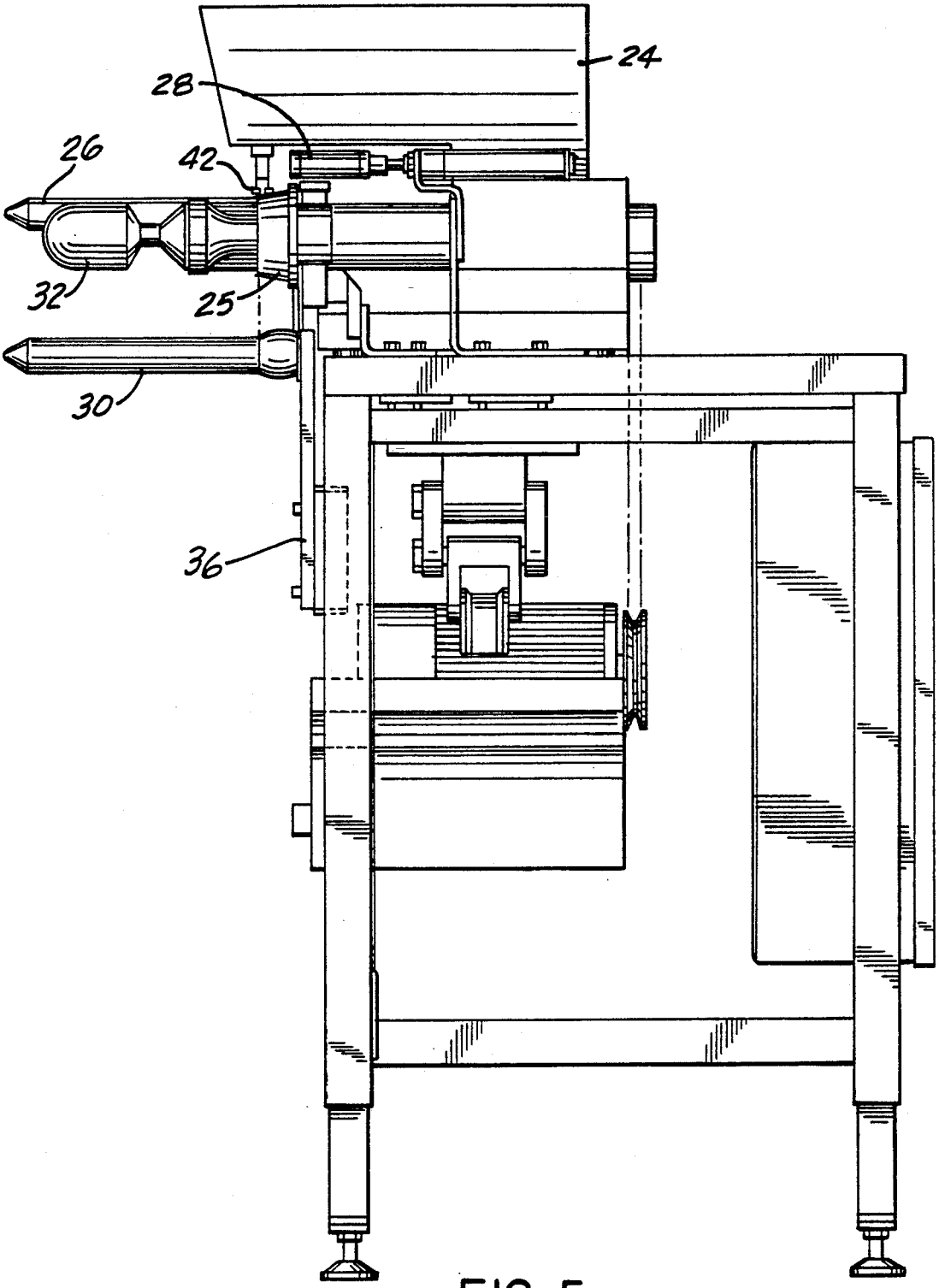
FIG. 5 is a side view of an attachment apparatus according to the invention.

FIGS. 4 and 5 show the main components of the attachment operation. FIG. 4 includes garment body 40 and elastic band 38 in order to demonstrate a "loaded" configuration. As garment body 40 is positioned over coarse guider roller 32, fine edge guider sensor 50 and coarse edge guider sensor 44, sewing process begins. Following the sequence programmed by the CPU, presser foot 42 is lowered to compress elastic band 38 and garment body 42. Rear puller roller 34 is positioned by rear puller lift cylinder 68 such that roller 34 is in contact with elastic band 38 and garment body 40. Tension roller 30 descends to its pre-programmed position, moving with tension roller carriage 36 and monitored by variable home and selected position magnetic proximity sensors 72 (see FIG. 1), to tension both elastic band 38 and garment body 40 to a pre-determined extent. Thereafter, sewing machine 24 is started and rear puller 34 and feed dog 46 begin to urge the workpieces through sewing machine 24. Examples of a feed dog mechanisms particularly applicable to this sewing process are taught in the pending U.S. patent application Ser. No. filed on Apr. 3, 1989 by Rohr entitled "Feed Dog Drive for Sewing Machines" (U.S. patent application Ser. No. 332,645) and in the pending U.S. patent application Ser. No. filed on Nov. 8, 1988 by Rohr, et al. entitled "A Sewing Machine for Sewing on a Tape" (U.S. patent application Ser. No. 268,817), both of which are incorporated by reference. The feed dog may be driven, for example, by a device such as the device disclosed in the U.S. patent application Ser. No. entitled "A Drive for a Reciprocating Part," filed by Rohr, et al. on Mar. 8, 1990 (U.S. patent application Ser. No. 490,780), which is incorporated by reference. FIG. 5 shows a side view of the invention and some of its parts discussed above, including sewing machine 24, roller 28, tension roller 30, tension roller carriage 36, Coarse guider roller 32, presser foot 42, roller 25 and roller 26.

As the movement of elastic band 38 and garment body 40 begins, fine edge guider sensor 50 and coarse edge guider sensor 44 monitor the alignment of the workpieces. These sensors send signals to control box 22 which uses the signals to determine the necessary manipulations of the workpieces during the sewing-aligning-realigning process.

Figure 5A:
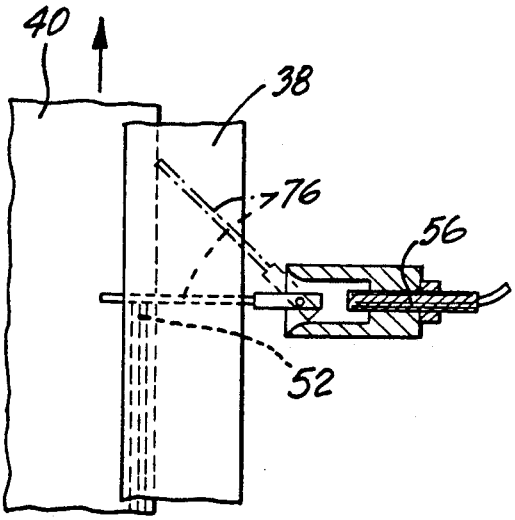
FIG. 5*a* is a top view of the top roller throw out seam sensor at the point when the start of stitching comes into contact with it.

FIG. 5*a* shows the operation of top roller throw out seam proximity sensor 56. As the start of the stitching 52 between elastic band 38 and garment body 40 passes spring biased pivoting lever 76, stitching 52 moves lever 76 in the direction of the workpieces' motion. This movement activates top roller throw out seam proximity sensor 56 which sends a signal to the CPU. The CPU, in turn, sends a signal which causes top roller 28 to retract from beneath elastic band 38. Although coarse guider roller 32 is also shut off, rear puller roller 34 and feed dog 46 continue to maneuver the workpieces through the sewing machine and to urge the workpiece from one side of presser foot 42 to the other.

Figure 5B:
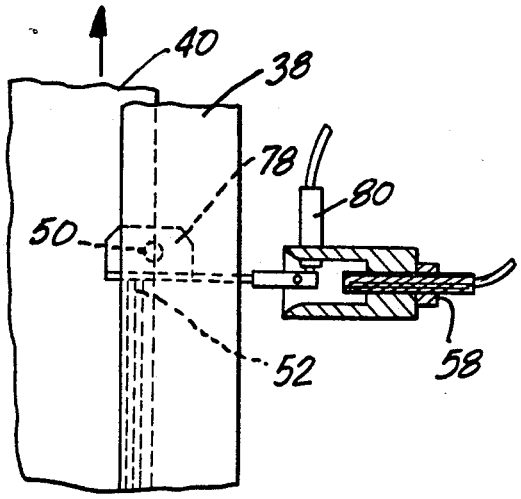
FIG. 5*b* is a top view of the configuration of the garment, elastic band and stitching when the stitching first comes in contact with the end of sew sensing mechanism.
Figure 5C:
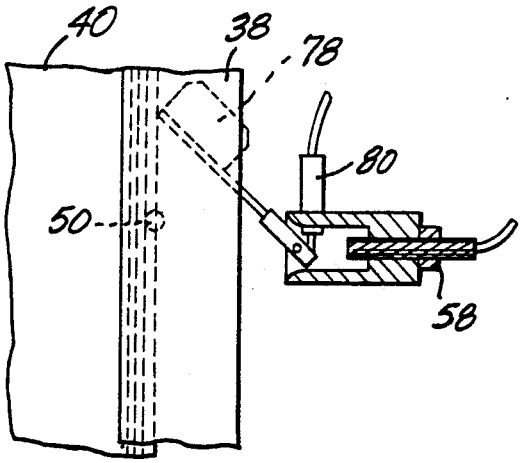
FIG. 5*c* is a top view of the end of sew sensing mechanism after the start of stitching has passed.

FIGS. 5*b* and 5*c* show the operation of end of sew proximity sensor 58 at the time just before and after start of stitching 52 comes into contact with sensor 58. When start of stitching 52 pushes end of sew flag 78, end of sew proximity sensor 58 sends a signal to the CPU. The signal initiates the CPU's stitch counting process. After a pre-determined stitch count has been generated, the sewing operation is terminated and all of the apparatus' mechanisms and controls return to the initial, stand-by configuration. This return to initial settings includes the return of end of sew flag 78 to its position out of the elastic band 38 for easier loading of elastic band 38 by the use of flag throw out cylinder 80.

The operator, or a mechanical means, may now unload the completed garment, and the apparatus is ready for the next operation cycle.

Figure 6A:
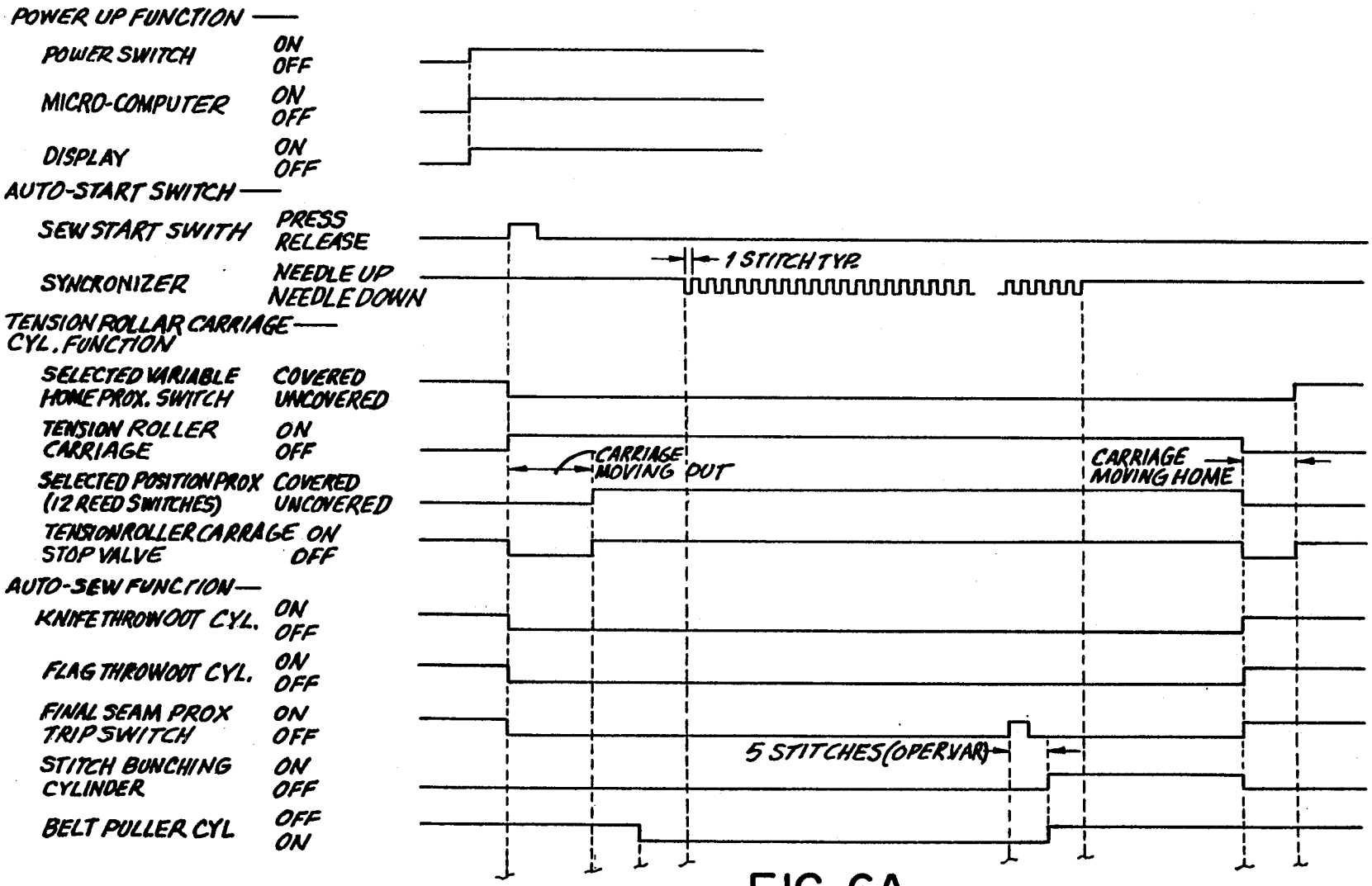
FIGS. 6*a* and 6*b* are portions of a timing chart demonstrating the sequence of activities in the attachment process.
Figure 6B:
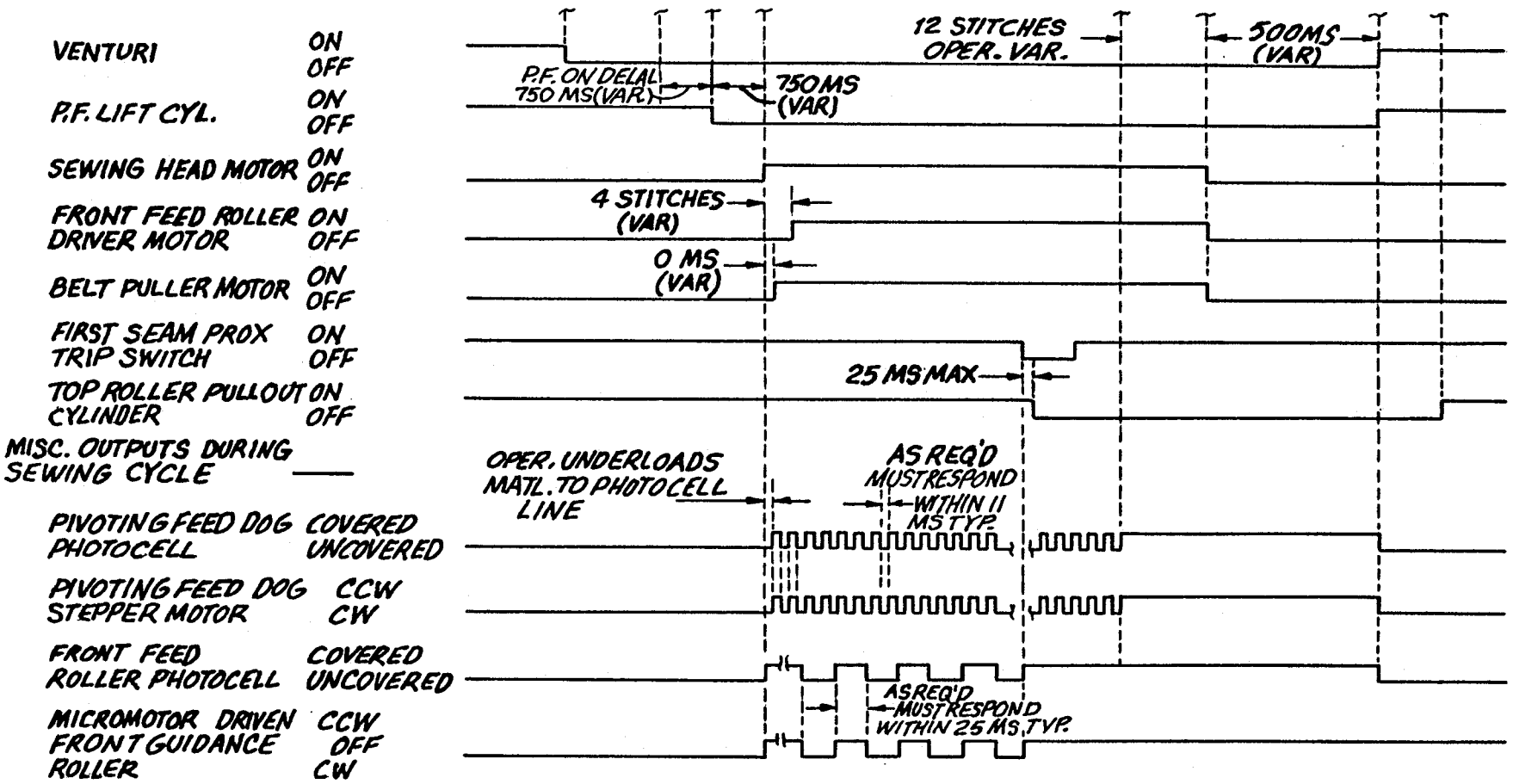

The timing of the automated activities, in a preferred embodiment, is shown in the timing chart illustrated in FIGS. 6*a* and 6*b*. The power up functions, the systems that come on when the power is turned on, include a micro-computer that controls and monitors the automated activities, and a display that provides a means for an operator to see the initial settings, to see changes made in the settings, and to monitor the programmed activities.

The automated activities begin when the end of sew sensor and the coarse guider sensor are covered by the garment body. The sewing start switch is pressed. In addition, the tensioning cylinder valve is turned on while the stop valve is turned off, which in combination lowers the tension roller (moving the carriage out and tensioning the workpieces). The tension cylinder moves the roller downward until the selected position proximity associated with the positioning sensors indicate that the tension roller is in its pre-determined position (which varies depending on the size of the garment).

Several automatic sewing functions are also commenced when the tension roller has reached the predetermined location. The knife throw out cylinder, the flag throw out cylinder, the final seam proximity trip switch (electrically connected to end of sew pivoting proximity sensor 58, see FIGS. 5*b* and 5*c*, and the venturi are all turned off. The knife throw out cylinder moves the knife into its operable position during the sewing process. It retracts the knife to a lower position after the sewing process is complete to make it easier to load the next workpieces. The flag throw out cylinder moves the flag to its normal position during the sewing process from a location away from the work area where the flag did not inhibit the easy loading of the workpieces. The venturi is a vacuum which sucks the workpiece edge trimmings after the knife has cut the edge of the garment body.

Other automatic sewing functions commence after the first set of automated activities has begun. For instance, a pre-determined time after the tension roller has been lowered, the belt puller cylinder is turned on while the presser foot lift cylinder is turned off (i.e. the presser foot is lowered). After another pre-determined delay, the synchronizer and the sewing head motor begins to move the sewing needle in the motion necessary to produce a seam that joins the elastic band to the garment body. (In addition, miscellaneous outputs produced during the sewing cycle such as those associated with the pivoting feed dog photocell, the pivoting feed dog stepper motor, the front feed roller photocell, and the micromotor driven front guidance roller are generated simultaneous with or very soon after the stitching begins.)

In a small interval of time after the stitching begins (e.g. a programmed duration equivalent to 0 m sec), the belt motor is turned on. After a pre-determined number of stitches (preferably 4 stitches), the front feed roller drive motor is turned on and the workpieces begin to move.

The sewing process is now in its programmed operation. This sewing operation continues until the first seam proximity trip switch (electrically connected to top roller throw out seam proximity sensor 56, see FIG. 5*a*) is turned off. This action is simultaneous with the termination of the front feed roller photocell (in a covered configuration) output and the micromotor driven front guidance rollers (in an off configuration) output.

After the trip switch is turned off, the top roller pullout cylinder, which had been on since the power switch was turned on, is automatically turned off, i.e. the top roller is retracted. (The first seam proximity trip switch turns back on sometime after the top roller pullout cylinder has been turned off, returning the switch to its initial position).

Later, the final seam proximity trip switch (electrically connected to end of sew pivoting proximity sensor 58, see FIGS. 5*a* and 5*b*) is turned on and off. When the switch is turned on, the stitch counting routine commences, the pivoting feed dog photocells begin to output a constant covered signal, and the pivoting feed dog stepper motor begins to output a counter-clockwise (CCW) signal.

The stitch bunching cylinder is turned on at the same time that the belt puller cylinder is turned off a predetermined number of stitches (e.g. 5 stitches) after the final seam proximity trip switch has been turned on. After another pre-determined number of stitches (e.g. 12 stitches), the sewing head motor, the front feed roller driver motor and the belt puller motor are turned off, thereby terminating the stitching activity.

After the stitching has stopped, (1) the tension roller is raised, (2) the selected position proximity are in the uncovered mode, (3) the knife throw out cylinder is turned on, (4) the flag throw out cylinder is turned on, (5) the final seam proximity trip switch is turned on for the second time during this cycle, (6) the stitch bunching cylinder is turned off, (7) the venturi is turned on, (8) the presser foot lift cylinder is turned on (raising the presser foot), (9) the pivoting feed dog photocell returns to its initial uncovered output mode, (10) the pivoting feed dog stepper motor returns to its initial clockwise (CW) mode, and (11) the front feed roller photocell returns to its initial uncovered mode.

When the tension roller carriage has returned to the initial position (the carriage has moved home and the tensioning cylinder stop valve has been turned on), the top roller pullout cylinder is turned off (returning the top roller to the loading position). At such time, all of the system components and signals have been returned to their initial status, the operator may remove the completed garment and load the apparatus in preparation for the next sewing (attachment) operation.

Figure 7:
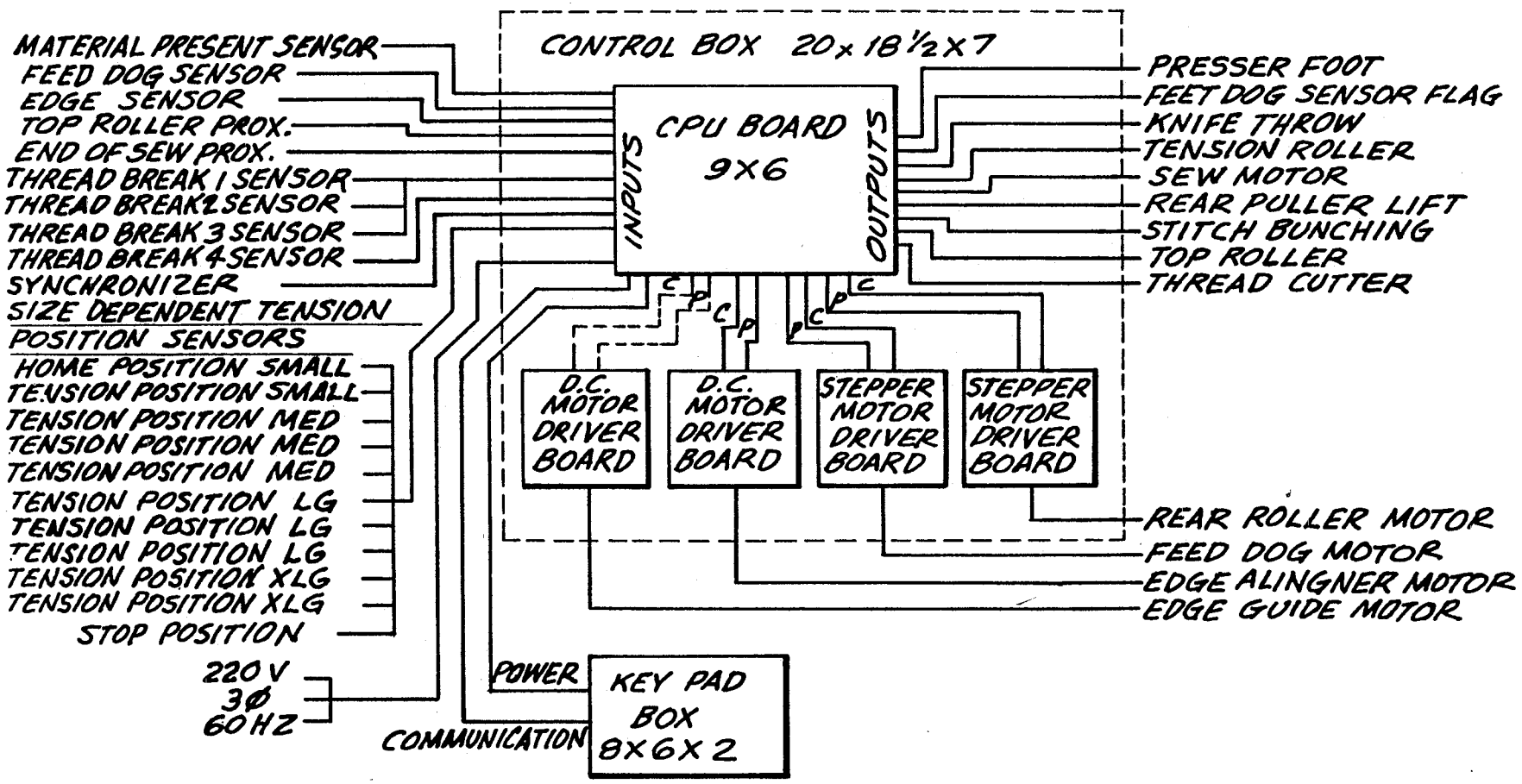
FIG. 7 is an interconnect diagram detailing the input/output of the attachment apparatus control system according to the invention.

The inputs and outputs of control box 22 (see FIGS. 1 and 5) are shown in FIG. 7. The inputs to control box 22 include inputs into the CPU such as sensor readings from position sensors, e.g. the feed dog sensor (fine edge guider sensor 48, see FIGS. 2 and 3) and the material present sensor (e.g. coarse edge guider sensor 44, see FIGS. 1, 2 and 3). Inputs also come from a signal from the synchronizer (in control box 22, see FIG. 1 and 5), end of sew proximity sensor 58 (see FIGS. 5*b* and 5*c*) and top roller proximity sensor 56 (see FIG. 5*a*). In addition, the CPU receives a 220 volt, 60 hz signal (3 degree phase shift), along with information from the machine operator's key pad box.

The output from the CPU comes directly from the CPU or indirectly via way of a D.C. motor driver board or stepper motor driver boards. The direct output goes to components that control such items as, for example, presser foot 42 (see FIGS. 2 and 3), the feet dog sensor flag (fine edge guider sensor 50), the knife (by manipulating knife throw out cylinder 70, see FIGS. 2 and 3), tension roller 30 (manipulated by tension roller carriage 36, see FIGS. 1, 4 and 5), the sewing machine motor (part of sewing machine 24, see FIGS. 1, 2, 3, 4 and 5), rear puller lift cylinder 68 (see FIGS. 2, 3 and 4), and top roller 28 (manipulated by cylinder 66, see FIGS. 1 and 5). The output from the stepper motor goes to rear roller motor 64 (see FIGS. 2, 3 and 4) and feed dog motor 74 (see FIGS. 2 and 3) while D.C. motors goes edge aligner motor and edge guider motor (which combined make up the stepper motor 62, see FIGS. 2 and 3).

Although illustrative preferred embodiments have thus been described herein in detail, it should be noted and will be appreciated by those skilled in the art that numerous variations may be made within the scope of this invention without departing from the principle of the invention and without sacrificing its chief advantages. For example, the workpiece materials may be placed in their initial position in the apparatus by a mechanical means instead of the manual means presented in this disclosure. The terms and expressions have been used as terms of description and not terms of limitation. There is no intention to use the terms or expressions to exclude any equivalents of features shown and described or portions thereof and the invention should be defined in accordance with the claims which follow.

We claim:

1. An apparatus for attaching a pre-closed band to a garment workpiece comprising:

means for loading said pre-closed band at said apparatus;

means for loading said garment workpiece at said apparatus;

attaching means for attaching said pre-closed band to said garment workpiece;

said apparatus including a tensioning roller for exerting active tension and for adjusting the tension exerted upon said pre-closed band and said garment workpiece during attachment to said garment workpiece, said tensioning roller engaging both said pre-closed band and said garment workpiece to actively pull said pre-closed band and said garment workpiece during attachment by said attaching means;

an upper roller engaging said pre-closed band to keep said garment workpiece and said pre-closed band separated from one another during alignment; and guiding means for guiding and aligning said pre-closed band and said garment workpiece through said attachment means.

2. An apparatus according to claim 1 including a sensor means for sensing an edge of said garment workpiece.

3. An apparatus according to claim 2 wherein said sensor means comprises a coarse edge guider sensor and a fine edge guider sensor.

4. An apparatus according to claim 2 wherein said guiding means includes a feed dog mechanism for maneuvering said preclosed band and said garment workpiece through said attaching means and for maintaining said edge of said garment workpiece in proper alignment.

5. An apparatus according to claim 1 wherein said guiding means includes at least one roller configured to transport and align said pre-closed band and said garment workpiece.

6. An apparatus according to claim 2 wherein said attaching means is a sewing machine.

7. An apparatus for attaching a pre-closed band to a garment workpiece comprising:

means for loading said pre-closed band at said apparatus;

means for loading said garment workpiece at said apparatus;

control means;

attaching means for attaching said pre-closed band to said garment workpiece;

a tensioning roller for exerting active tension and for adjusting the tension exerted upon said pre-closed band during attachment to said garment workpiece, said tensioning roller engaging both said pre-closed band and said garment workpiece to actively pull said pre-closed band and said garment workpiece to tension said pre-closed band and said garment workpiece during attachment of said pre-closed band to said garment workpiece by said attaching means;

at least one sensor for monitoring said pre-closed band and said garment workpiece positions and signalling said positions to said control means;

guiding means for guiding and aligning said pre-closed band and said garment workpiece through said attachment means in response to signals for said control means; and an upper roller engaging said pre-closed band to keep said garment workpiece and said pre-closed band separated from one another during alignment.

8. An apparatus according to claim 7 wherein said attaching means is a sewing machine.

9. A method of attaching a pre-closed band to a garment workpiece including the steps of:

continuously applying active tension to said pre-closed band and said garment workpiece and adjusting the tension exerted upon same by engaging a tensioning roller to said pre-closed band to pull said pre-closed band and said garment workpiece during the attachment operation;

sensing said pre-closed band and said garment workpiece positions;

aligning and guiding said pre-closed band and said garment workpiece in response to said sensed positions while keeping said pre-closed band and said garment workpiece separated during alignment; and attaching said tensioned and aligned pre-closed band to said tensioned and aligned garment workpiece.

* * * * *